US005641317A

United States Patent [19]

Huang

[11] Patent Number: 5,641,317

[45] Date of Patent: Jun. 24, 1997

[54] TRANSMISSION MECHANISM OF A TOY HELICOPTER

[75] Inventor: Tien Fu Huang, Taipei, Taiwan

[73] Assignee: Wen Ho Tsai, Taipei, Taiwan

[21] Appl. No.: 533,893

[22] Filed: Sep. 26, 1995

[51] Int. Cl.[6] ..... A63H 17/25

[52] U.S. Cl. ..... 446/232; 446/236; 446/279; 446/441

[58] Field of Search ..... 446/230, 232, 446/236, 272, 280, 281, 441, 465, 279

[56] References Cited

U.S. PATENT DOCUMENTS

| | | | |
|---|---|---|---|
| 1,609,167 | 11/1926 | Heyman | 446/230 |
| 2,732,656 | 1/1956 | Cohn | 446/232 |
| 3,613,305 | 10/1971 | Suzuki | 446/232 |
| 4,120,099 | 10/1978 | Fett | 446/230 |
| 4,467,556 | 8/1984 | Iwao et al. | 446/230 |
| 5,139,456 | 8/1992 | Chuang | 446/236 |

*Primary Examiner*—Robert A. Hafer
*Assistant Examiner*—Jeffrey D. Carlson
*Attorney, Agent, or Firm*—Pro-Techtor International

[57] ABSTRACT

A transmission mechanism of a toy helicopter, including a casing disposed in a housing of the helicopter, a motor disposed in the casing and a gear set driven by the motor to drive a pair of cams. Each cam is formed with a peripheral groove within which two rocking arms are driven to regularly swing. The rocking arm simultaneously drives a linking lever and a torque spring. The torque spring drives a lifting support shaft to move up and down. The linking lever is levered about a fulcrum and has an inclined board at one end. The inclined board has an inclined side for contacting with two seat boards pulled by springs, whereby when the linking lever swings, the inclined side of the inclined board outward pushes the seat boards. When released from the pushing force, the seat boards are resiliently restored to home position.

8 Claims, 8 Drawing Sheets

TRANSMISSION MECHANISM OF A TOY HELICOPTER

BACKGROUND OF THE INVENTION

The present invention relates to a transmission mechanism of a toy helicopter, and more particularly to a transmission mechanism of a toy helicopter, which is able to move the helicopter up and down and rotate the helicopter and the propeller thereof. In addition, the transmission mechanism is able to move the missile hanging brackets up and down and close or open the doors of the helicopter.

A conventional toy helicopter has simple functions such as rotating the propeller and running on the ground. Such operations are monotonous and not attractive. Another conventional toy helicopter is designed with more operations. However, such toy helicopter has a complicated transmission mechanism and thus is quite expensive.

Therefore, it is necessary to provide a transmission mechanism of a toy helicopter, which can create versatile operations while being manufactured at low cost.

SUMMARY OF THE INVENTION

It is a primary object of the present invention to provide a transmission mechanism of a toy helicopter, which has simple structure while being able to create versatile operations of the helicopter, such as moving the helicopter up and down, rotating the helicopter and the propeller thereof, moving the missile hanging brackets up and down and closing or opening the doors of the helicopter. The transmission mechanism is manufactured at low cost while creating various operations.

The present invention can be best understood through the following description and accompanying drawings, wherein:

Figure 1:
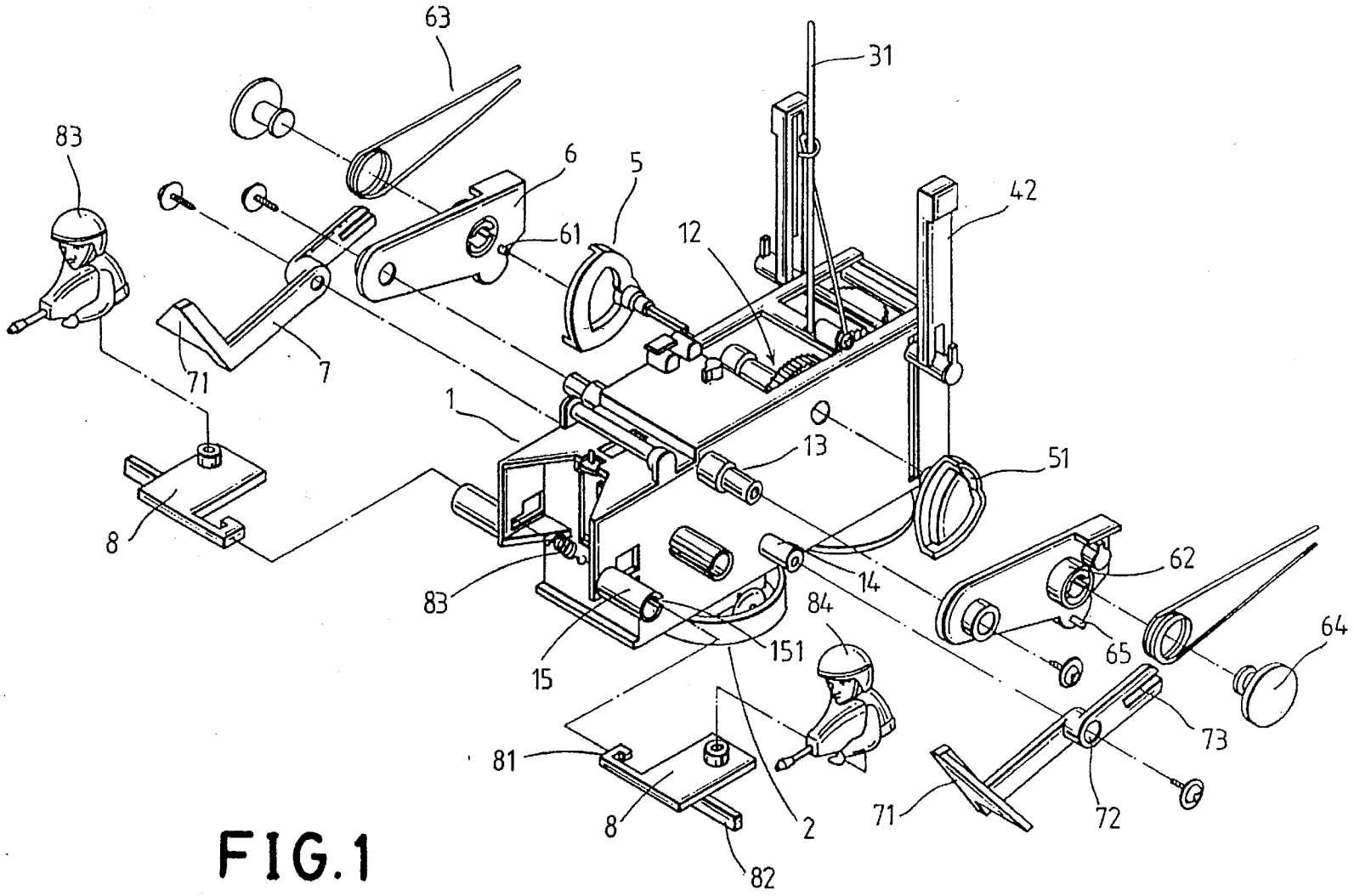
FIG. 1 is a perspective exploded view of a preferred embodiment of the present invention.
Figure 4:
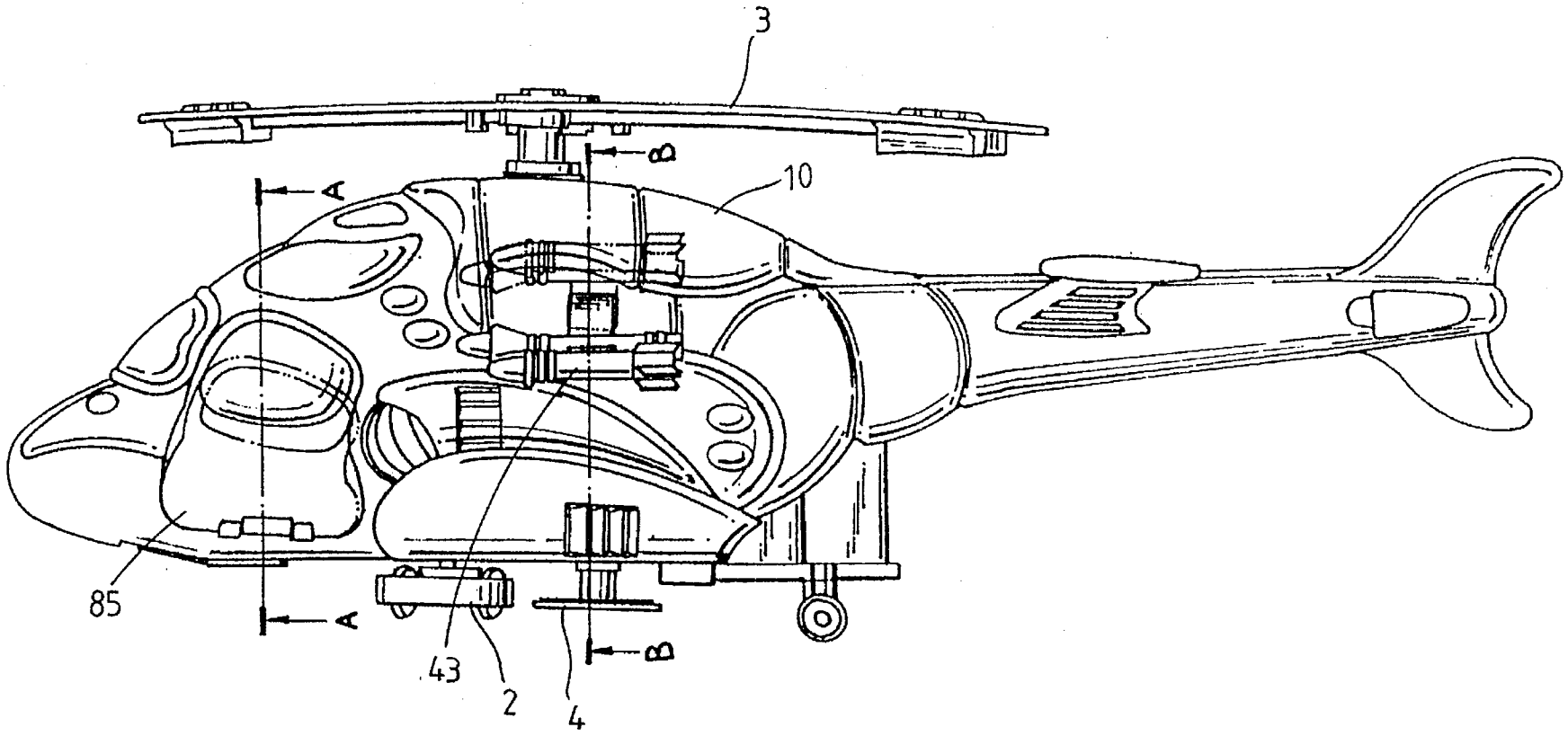
Figure 5A:
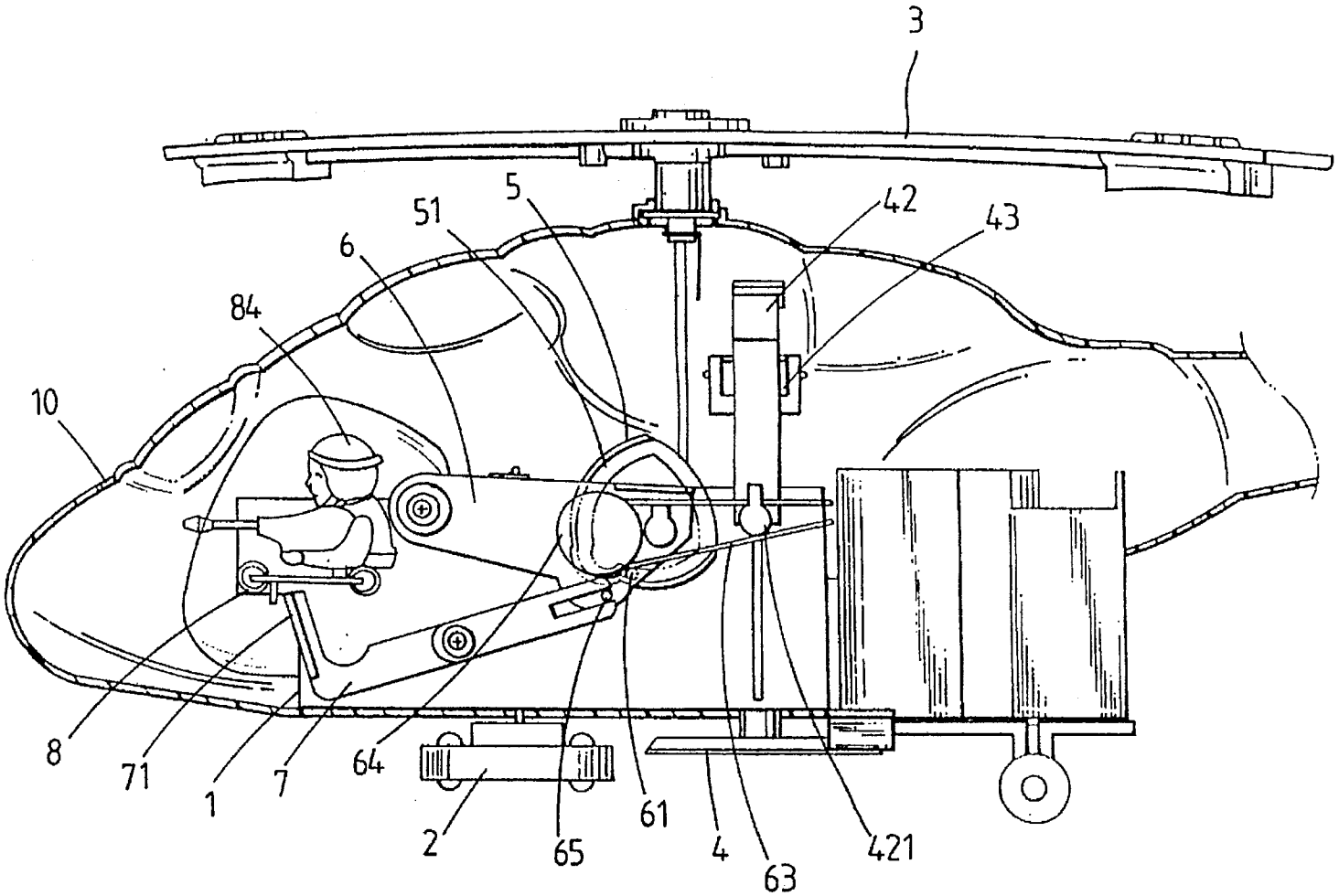
Figure 5B:
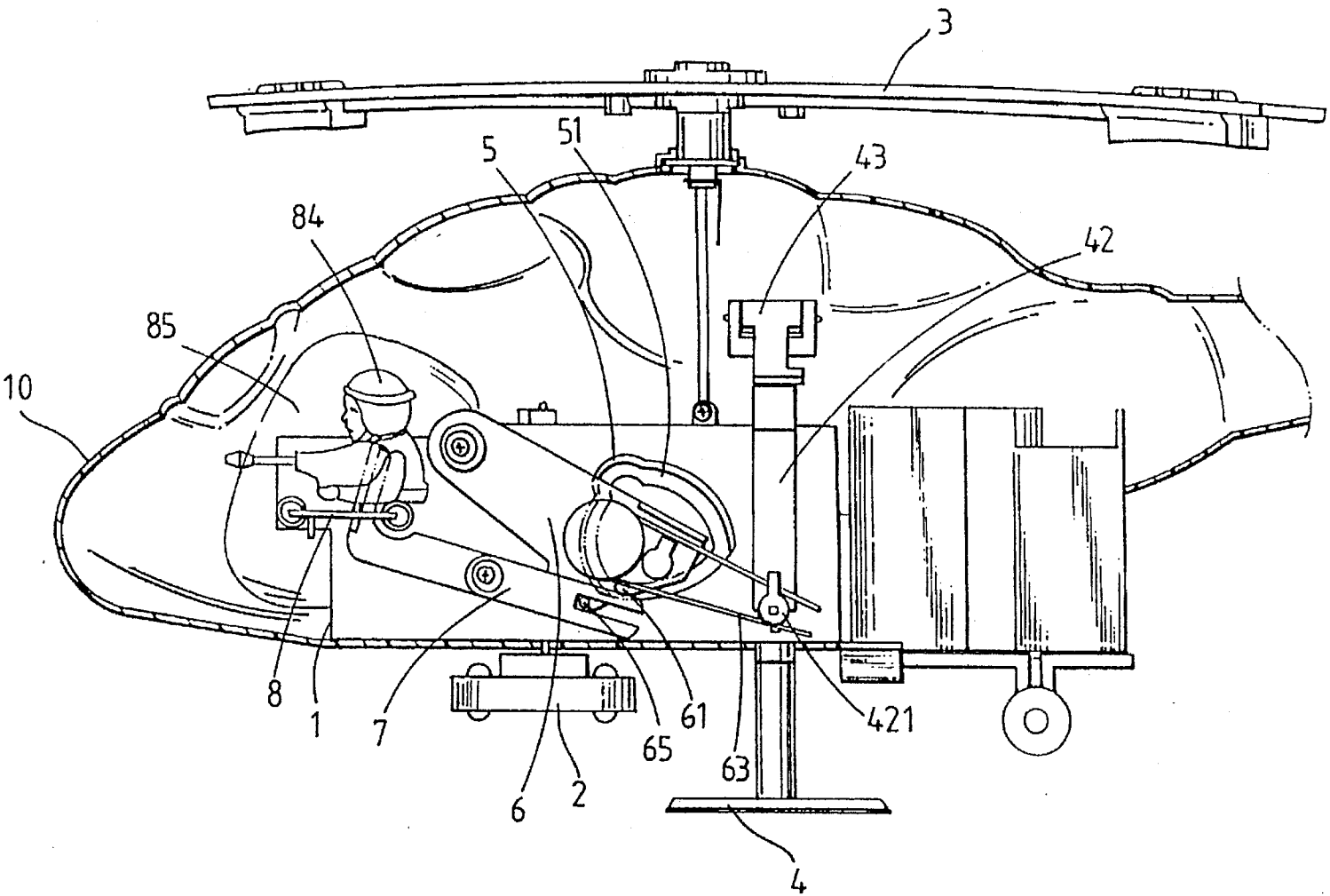
Figure 6A:
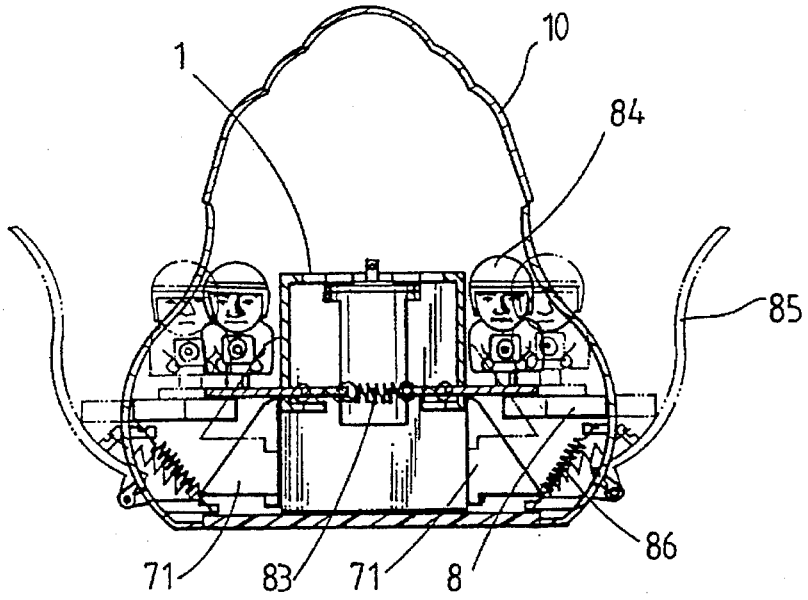
Figure 6B:
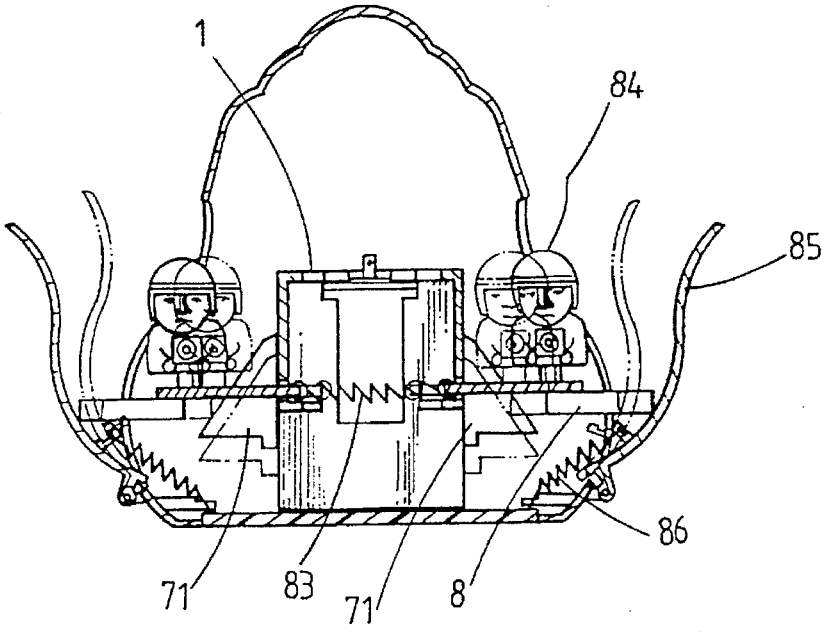
Figure 7A:
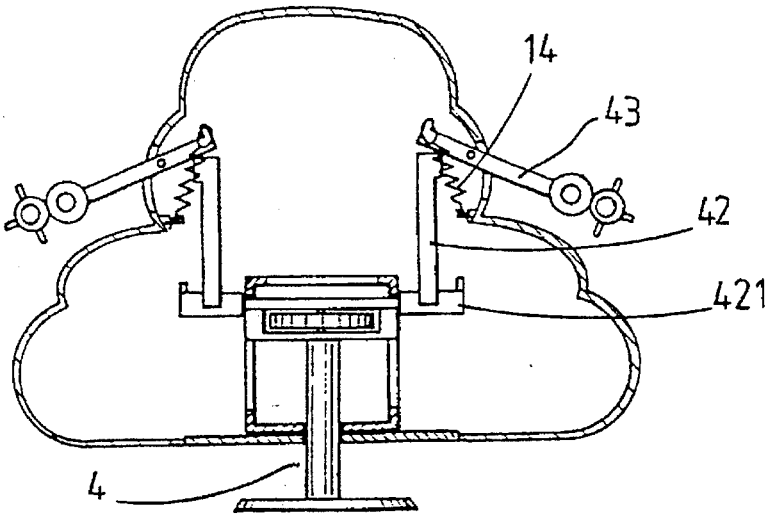
Figure 7B:
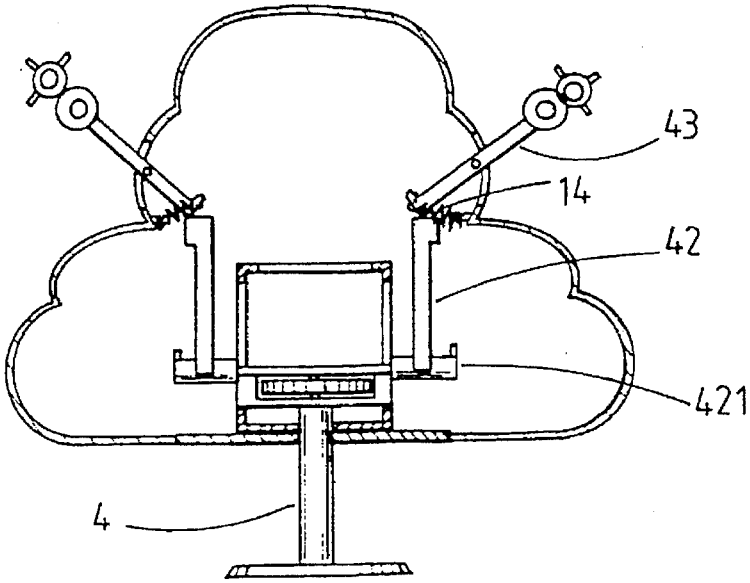

3 is a longitudinal sectional view of the embodiment of FIG. 1;

FIG. 4 is a plane side view of the embodiment of FIG. 1;

FIG. 5-A shows a state before the cam drives the rocking arm and linking lever;

FIG. 5-B shows a state during which the cam drives the rocking arm and linking lever;

FIG. 6-A is a sectional view taken along line A—A of FIG. 4, showing an operation of the helicopter;

FIG. 6-B is a sectional view taken along line A—A of FIG. 4, showing another operation of the helicopter;

FIG. 7-A is a sectional view taken along line B—B of FIG. 4, showing that the hanging bracket is moved upward; and FIG. 7-B is a sectional view taken along line B—B of FIG. 4, showing that the hanging bracket is moved downward.

DETAILED DESCRIPTION OF THE PREFERRED EMBODIMENT

Figure 2:
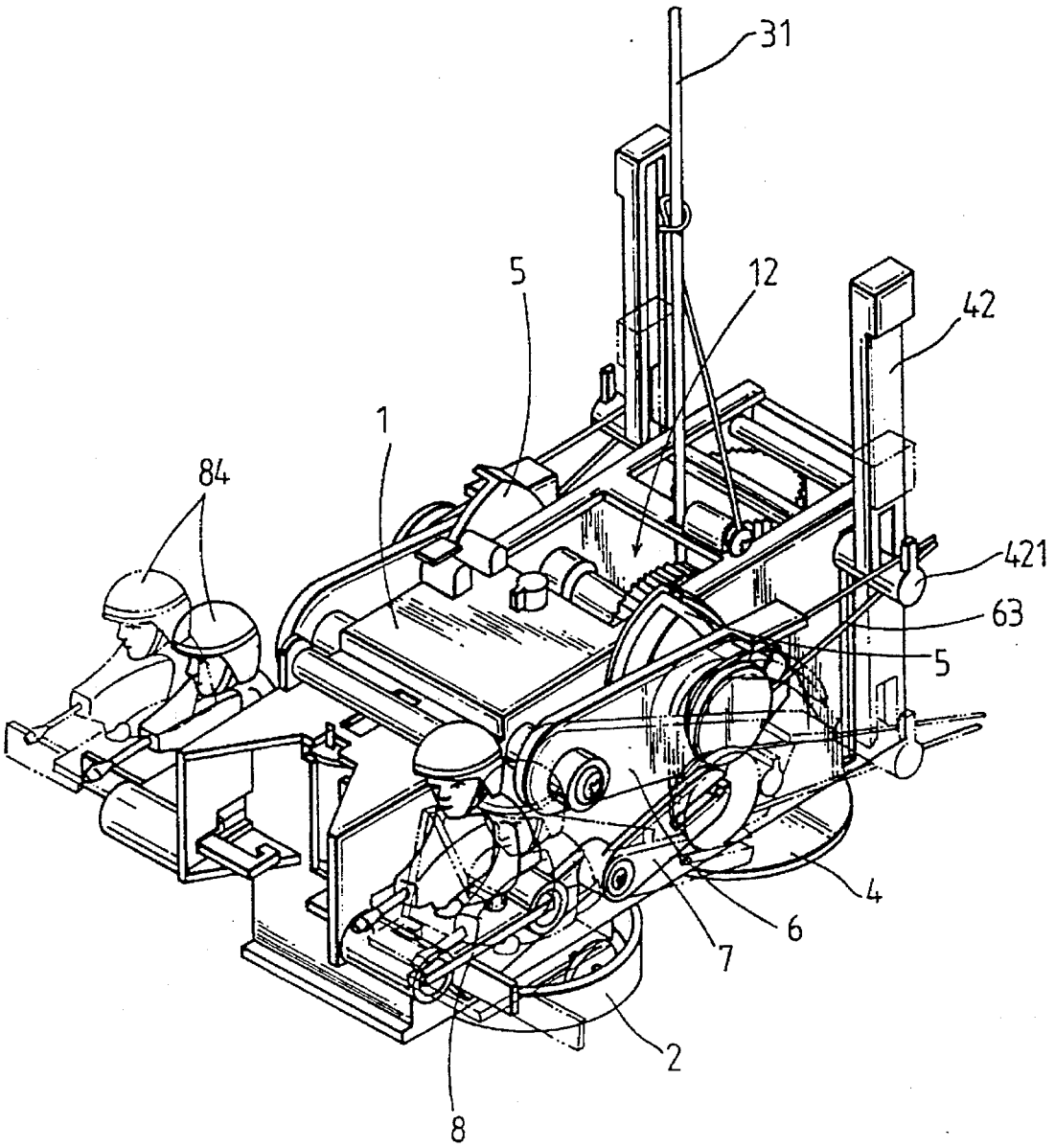
FIG. 2 is a perspective assembled view according to FIG. 1.
Figure 3:
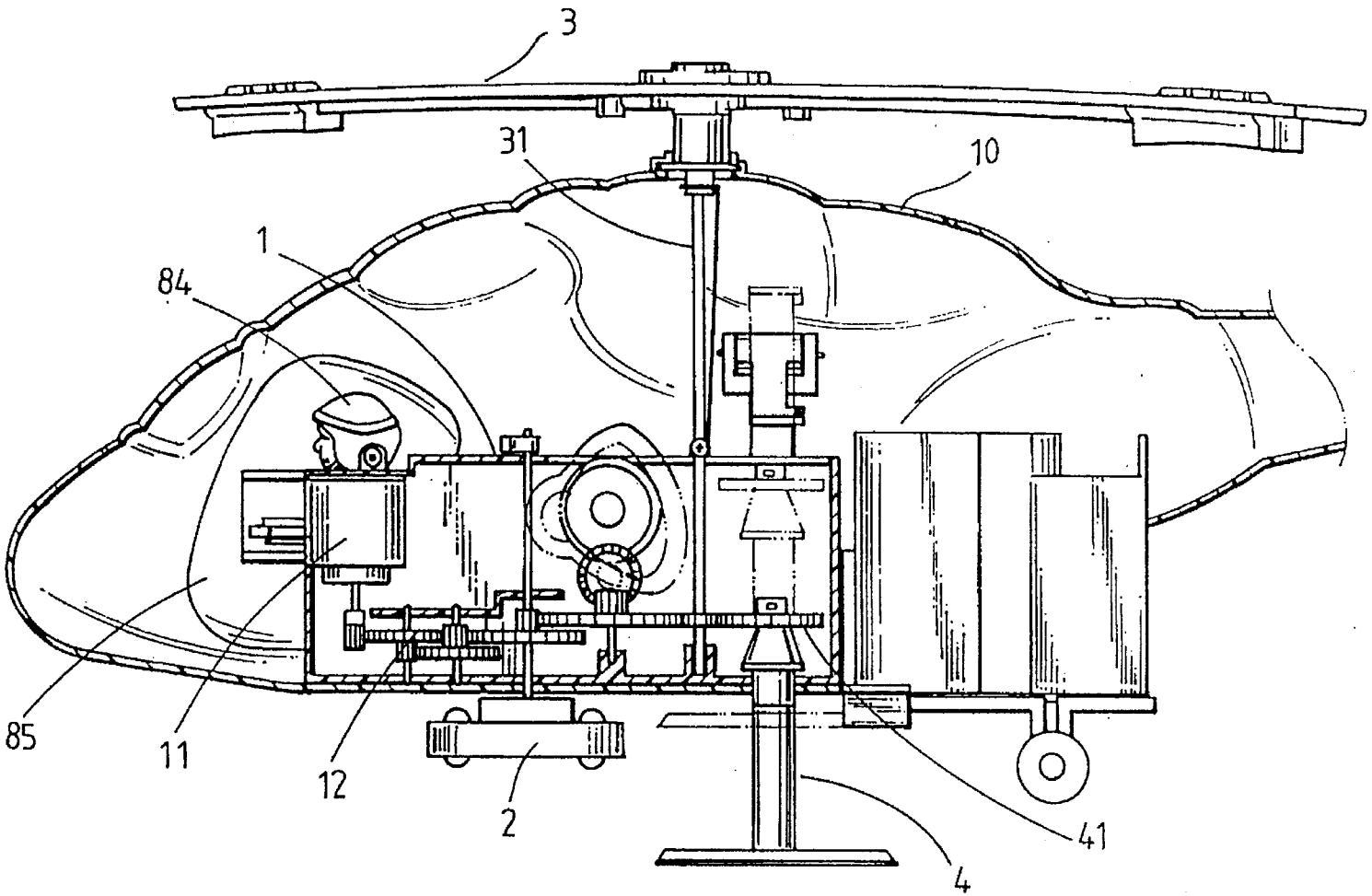

Please refer to FIGS. 1 to 3. The present invention includes a casing 1 disposed in a housing 10, a motor 11 disposed in the casing 1 at one end, a gear set 12 connecting the motor 11 with a rotary power wheel set 2 and a driving shaft 31 for a propeller 3 and two cams 5 disposed on two outer sides of the casing 1 for outputting power. The cam 5 is formed with peripheral groove 51. The two sides of the casing 1 are formed with a first support seat 13, a second support seat 14 and a slide seat 15 respectively. The first support seat 13 is coupled with one end of a rocking arm 6. The other end of the rocking arm 6 on inner side has a projecting pin 61 extending into the peripheral groove 51 of the cam 5. The outer side of the rocking arm 5 has a projecting seat 62 and a cooperative spring clip 64 for clamping a torque spring 63. The second support seat 14 is for a central hole 72 of a linking lever 7 to engage and locate therein. The linking lever 7 has an inclined board 71 at one end and a fork slot 73 at the other end for slidably inserting with a projecting pin 65 beside the projecting seat 62. The slide seat 15 is disposed with a slide seat slot 151 for two seat boards 8 to slidably insert therein. The seat board 8 has a pull hook 81 on inner side. Two ends of a spring 83 are hooked on the pull hooks 81 of the seat boards 8, whereby the spring 83 urges the seat boards 8 to inward move toward each other on the inclined side of the inclined board 71 of the linking lever 7. The outer side of the seat board 8 is disposed with an abutting section 82. The rear end of the casing 1 is disposed with a lifting support shaft 4. A gear 41 is disposed at the top end of the lifting support shaft 4 and two lifting levers 42 are disposed on two outer sides of the casing 1. The lifting levers 42 are connected with the lifting support shaft 4. The bottom end of the lifting lever 42 is disposed with a clamping point 421 for the front end of the torque spring 63 to clamp.

Please refer to FIGS. 4, 5-1 and 5-2. The linking lever 7 forms a lever with the central hole 72 serving as a fulcrum. The first support seat 13 serves as a fulcrum of the rocking arm 6, whereby when the cam 5 rotates to drive the rocking arm 6 to swing about the first support seat 13, the projecting pin 65 of the rocking arm 6 drives the fork slot 73 to make the linking lever 7 swing up and down. At this time, the torque spring 63 is driven by the linking lever 7 and the clamping point 421 lifts the lifting support shaft 4 and the lifting lever 42 (as shown in FIG. 5-1) or descends the same (as shown in FIG. 5-2).

Please refer to FIGS. 6-1 and 6-2. The housing 10 is disposed with a pivotable door 85 corresponding to the doll 84. When pulled back by a restoring spring 86, the fork slot 73 of the linking lever 7 is driven by the rocking arm 6 to make the inclined board 71 swing up and down. When the inclined board 71 ascends ( as shown in FIG. 6-2 ), the inclined side outward pushes the seat boards 8. In turn, the abutting sections 82 of the seat boards 8 push the doors 85 and open the same and the dolls 84 are transversely moved outside along with the seat boards 8. When the inclined boards 71 descend (as shown in FIG. 6-1), the seat boards 8 are inward inclinedly pulled toward each other by the spring 83 and the abutting sections 82 no more push the doors 85 so that the doors 85 are pulled back to the close position by the restoring spring 86.

Please refer to FIGS. 7-1 and 7-2. A pair of hanging brackets 43 are pivotally suspended from the housing 10 corresponding to the upper side of the lifting lever 42. One end of the hanging bracket 43 is biased against the lifting lever 42. An extension spring 44 is drivingly connected with the housing 10. The other end of the hanging bracket 43 is extended outside the housing 10 and a decorative weapon such as a missile is mounted at the end. Therefore, the clamping point 421 of the torque spring 63 can drive the lifting support shaft 4 and the lifting lever 42 to descend as shown in FIG. 7-2 so as to lift and support the entire toy helicopter. At this time, the descending lifting lever 42 makes one end of the hanging bracket 43 pulled by the extension spring 44 with the other end of the hanging bracket 43 upward lifted, so that the missile on the hanging bracket 43 is lifted. When the lifting support shaft 4 ascends as shown in FIG. 7-1, the helicopter descends. At this time, the lifting lever 42 ascends along therewith and one end of the hanging bracket 43 is pushed by the lifting lever 42 and the other end of the hanging bracket 43 descends to make the missile on the bracket 43 descend.

The operation of the present invention is as follows:

When the motor 11 is powered on, the gear set 12 is driven to drive the rotary power wheel set 2 and the propeller 3.

The cams 5 drive the rocking arm 6 and the linking lever 7 to operate. When the torque spring 63 is driven by the linking lever 7 to make the clamping point 421 positioned at an upper dead end as shown in FIG. 5-1, the helicopter descends and runs around by means of the rotary power wheel set 2. At this time, the missiles on the hanging brackets 43 also descend as shown in FIG. 7-1 and the inclined board 71 also descends with the doors 85 in the close position as shown in FIG. 6-1. When the clamping point 421 is positioned at the lower dead end as shown in FIG. 5-2, the lifting support shaft 4 lifts and supports the helicopter and the rotary power wheel set 2 leaves the ground without any driving effect. At this time, the gear 41 at the top end of the lifting support shaft 4 descends to engage with the gear set 12 and by means of the power of the gear set 12, the entire helicopter is rotated in the air and the missiles on the hanging brackets 43 ascend as shown in FIG. 7-2 and the inclined board 71 also ascends to push the seat boards 8 outward. The abutting sections 82 of the seat boards 8 push the doors 85 and open the same with the dolls 84 transversely moved outside as shown in FIG. 6-2.

In conclusion, the transmission mechanism of the toy helicopter of the present invention is able to create versatile operations and thus achieve a more entertaining effect.

It should be noted that many modifications of the above preferred embodiment can be made without departing from the spirit of the present invention. The scope of the present invention should be defined only by the appended claims.

What is claimed is:

1. A transmission mechanism of a toy helicopter, comprising a casing disposed in a housing of the helicopter, a motor disposed in the casing and a gear set driven by the motor driving a pair of cams, each cam being formed with a peripheral groove within which a rocking arm is driven to regularly swing, the rocking arm simultaneously drivingly swinging a linking lever and a torque spring, said torque spring driving a lifting support shaft to move up and down, the linking lever being levered about a fulcrum and having an inclined board at one end, the inclined board having an inclined side contacting a seat board, whereby when the linking lever swings, the inclined side of the inclined board outwardly pushes the seat board, the seat board being drivingly connected with the casing by a resilient member, whereby when released from the pushing force of the inclined board, the seat board is resiliently restored to its home position.

2. A transmission mechanism as claimed in claim 1, wherein a gear is disposed at a top end of the lifting support shaft, whereby when the lifting support shaft descends to a lower dead end, the gear engages with the gear set and the helicopter is lifted and supported by the lifting support shaft so that the helicopter can rotate about the lifting support shaft in the air.

3. A transmission mechanism as claimed in claim 1, wherein the lifting support shaft is connected with two lifting levers, whereby the lifting levers move up and down to push one end of two hanging brackets so as to make the other end of the hanging brackets move up and down by means of levering.

4. A transmission mechanism as claimed in claim 1, wherein the outer side of the seat board is disposed with an abutting section, whereby when the seat board is outwardly shifted, the abutting section pivots open a resilient pivotable member of the housing.

5. A transmission mechanism as claimed in claim 4, wherein the resilient pivotable member is a door pivotally mounted on the housing of the helicopter and drivingly connected with the housing by a restoring spring.

6. A transmission mechanism as claimed in claim 1, wherein the gear set drives a driving shaft and one end of the driving shaft directly drives a propeller to rotate.

7. A transmission mechanism as claimed in claim 1, wherein the gear set directly drives a rotary power wheel set to rotate.

8. A transmission mechanism as claimed in claim 1, wherein a doll is disposed on the seat board.

* * * * *